US012692634B2

(12) United States Patent
Gehring et al.

(10) Patent No.: US 12,692,634 B2
(45) Date of Patent: Jul. 28, 2026

(54) MODULAR ATTACHMENT SYSTEM TEXTILE WITH INTEGRALLY KNIT SLITS AND MANUFACTURING METHOD THEREOF

(71) Applicants: George Gehring, New Suffolk, NY (US); William Brown, Deerfield, MA (US)

(72) Inventors: George Gehring, New Suffolk, NY (US); William Brown, Deerfield, MA (US)

(73) Assignee: Gehring-Tricot Corporation, Dolgeville, NY (US)

( * ) Notice: Subject to any disclaimer, the term of this patent is extended or adjusted under 35 U.S.C. 154(b) by 0 days.

(21) Appl. No.: 18/591,354

(22) Filed: Feb. 29, 2024

(65) Prior Publication Data

US 2025/0277329 A1 Sep. 4, 2025

(51) Int. Cl.

| | |
|---|---|
| ***D04B 21/20*** | (2006.01) |
| ***D04B 21/10*** | (2006.01) |
| *A45F 5/02* | (2006.01) |

(52) U.S. Cl.

CPC ..... *D04B 21/20* (2013.01); *D04B 21/10* (2013.01); *A45F 2005/023* (2013.01)

(58) Field of Classification Search

CPC ..... D04B 21/10; D04B 21/20; D04B 21/205; D04B 21/207; D04B 21/14; D04B 23/16; A45F 5/02; A45F 5/021; A45F 5/023; A45F 3/14; A41F 1/00; A41F 1/008

See application file for complete search history.

(56) References Cited

U.S. PATENT DOCUMENTS

| | | | | | |
|---|---|---|---|---|---|
| 752,033 | A * | 2/1904 | Clewley | D04B 21/10 | 66/193 |
| 1,475,333 | A * | 11/1923 | Ward | D04B 21/18 | 66/195 |
| 1,803,476 | A * | 5/1931 | Kappler | D04B 21/06 | 66/85 R |
| 2,083,991 | A * | 6/1937 | Geller | A47H 23/08 | 160/237 |
| 2,233,664 | A * | 3/1941 | Deri | D04B 27/26 | 66/201 |
| 2,326,713 | A * | 8/1943 | Wesseler | F41H 5/06 | 2/2.5 |
| 2,371,039 | A * | 3/1945 | Fischel | A47H 23/08 | 160/390 |
| 2,668,587 | A * | 2/1954 | London | D04B 21/10 | 160/349.2 |
| 2,691,286 | A * | 10/1954 | Cooper | D04B 21/10 | 66/192 |
| 3,084,529 | A * | 4/1963 | Scheibe | D04B 27/32 | 66/193 |
| 4,074,543 | A * | 2/1978 | Schmidt | D04B 21/12 | 66/193 |

(Continued)

FOREIGN PATENT DOCUMENTS

| | | | | |
|---|---|---|---|---|
| NO | 743257 L | * | 4/1975 | D04B 21/10 |
| WO | WO-2017214620 A1 | * | 12/2017 | A61F 2/0063 |

*Primary Examiner* — Danny Worrell

(74) *Attorney, Agent, or Firm* — Brian M. Dingman; Prince Lobel Tye LLP

(57) ABSTRACT

A grid accessory attachment platform with a knitted textile that has a number of spaced slits integrally knit into the textile.

17 Claims, 6 Drawing Sheets

(56) References Cited

U.S. PATENT DOCUMENTS

| | | | | | |
|---|---|---|---|---|---|
| 4,133,191 | A * | 1/1979 | Blore | D04B 1/104 | 28/163 |
| 4,377,195 | A * | 3/1983 | Weil | A61G 12/00 | 160/237 |
| 4,395,889 | A * | 8/1983 | Schnegg | D04B 21/14 | 66/193 |
| 4,920,769 | A * | 5/1990 | Rickerl | A41B 9/004 | 2/406 |
| 5,674,122 | A * | 10/1997 | Krech | D04B 21/10 | 51/299 |
| 6,212,913 | B1 * | 4/2001 | Weiss | D04B 21/10 | 139/389 |
| 7,757,517 | B2 * | 7/2010 | Malloy | F16L 59/026 | 66/170 |
| 7,874,184 | B2 * | 1/2011 | Malloy | D04B 1/22 | 66/170 |
| 11,447,898 | B2 * | 9/2022 | Amis | D04B 1/104 | |
| 2001/0042388 | A1 * | 11/2001 | West | D04B 21/10 | 66/195 |
| 2014/0367427 | A1 * | 12/2014 | Bjelde | F41C 33/002 | 224/257 |
| 2015/0335140 | A1 * | 11/2015 | Cole | A45F 3/00 | 24/3.1 |

* cited by examiner

MODULAR ATTACHMENT SYSTEM TEXTILE WITH INTEGRALLY KNIT SLITS AND MANUFACTURING METHOD THEREOF

BACKGROUND

This disclosure relates to a textile with integral slits.

To accommodate the need to carry specialized tools for ready use at any time, soldiers and police officers, for example, rely on various textile based accessory attachment systems. An example standardized attachment system employed by U.S. Armed Forces is the MOLLE (MOdular Lightweight Load carrying Equipment) system. The MOLLE system permits the attachment of various MOLLE-compatible accessories, such as holsters, magazine pouches, radio pouches, knife sheathes, and other gear to MOLLE-compatible load-bearing garments, such as vests, belts, backpacks, and jackets.

The modularity of the MOLLE system comes from the use of grid platforms on load-bearing garments, the webbing-based Pouch Attachment Ladder System (PALS) is one such example. The PALS webbing defines an array of vertically aligned open loops that consists of horizontal rows of 1 inch nylon webbing spaced 1 inch apart and attached to a backing fabric panel at 1.5-inch intervals. Accessories attach to the loops with various hooks, straps or fasteners which engage with one or more loops.

In grid platforms that employ webbing to construct the grid, such as PALS, the webbing is secondarily bonded to the platform by tack stitching or other means. This secondary bonding of the grid introduces potential points of failure into the systems, adds complexity to the manufacturing process, and increases the weight of the system. Additionally, the webbing adds bulk to the system which can reduce the mobility of the wearer.

Alternately webless grid platforms can be constructed by slitting the textile platform, often a laminated structure, in the appropriate grid pattern through laser cutting, die cutting, or other means. As in the cases of the webbing construction slitting of the platform grid introduces potential failure points into the platform and adds complexity to the manufacturing process. While increasing the strength of the platform can compensate for the potential failure points introduced by the slitting, doing so usually increases the overall weight of the system. Additionally laminated textiles can be compromised by delamination caused by water intrusion due to capillary action and environmental thermal cycling. This is of particular concern in the Maritime environment. Laminated textiles can also reduce the breathability of the system, impacting comfort for the wearer.

Another disadvantages of the prior art includes difficulty in tailoring the system for a given application, for example attempts to render a webbing grid platform lighter or more drapable can yield a reduction in durability and strength, with similar results in slit laminate platforms.

SUMMARY

In view of the foregoing disadvantages inherent in the known types of modular attachments systems and methods now present in the prior art, the present invention provides a new technique through the novel use of a Modular Attachment System Textile with Integrally Knit Slits and Manufacturing Method Thereof. The use of a Modular Attachment System Textile with Integrally Knit Slits according to the present invention substantially departs from the conventional concepts and designs of the prior art and in doing so overcomes the deficiencies of the prior art.

Aspects and examples are directed to an attachment system and manufacturing method thereof is disclosed for textiles used in articles such as, but not limited to, vests, belts, backpacks, and jackets, for carrying accessories, such as but not limited to holsters, magazine pouches, radio pouches, knife sheathes, and other gear that overcomes one or more of the aforementioned disadvantages of the prior art.

In one preferred embodiment of the invention slits are integrally knit into the textile to produce the grid attachment platform. In another preferred aspect of the invention the Modular Attachment System Textile with Integrally Knit Slits is produced by Warp Knitting.

By integrally knitting the slits into the textile the slits are no longer potential failure points in the textile, manufacturing steps and complexity are reduced, and weight can be reduced eliminating material when compared to the prior art.

Additional advantages of this invention over the prior art include, but are not limited to, designed compatibility with the prior art, by way of non-limiting example—MOLLE-PALS; tailorability to current and future needs and requirements through fiber selection and knit architecture (e.g. fire resistance, reduced weight, etc.); reduced bulk and lower profile; breathability for wearer moisture control and water drainage in the case of submersion; as it is an integrated textile solution once the base materials are produced with the integral slit grid, article patterns need only be cut and stitched or assembled together to produce the final product.

All examples and features mentioned below can be combined in any technically possible way.

In one aspect, a grid accessory attachment platform includes a knitted textile with a plurality of spaced slits integrally knit into the textile.

In another aspect, a method of creating a grid accessory attachment platform using a warp knitting machine includes using a plurality of guide bars to knit a textile with a plurality of spaced slits integrally knit into the textile.

Some examples include one of the above and/or below features, or any combination thereof. In an example the textile is produced by warp knitting. In an example the slits have a length and a width, with the lengths greater than the widths such that the slits are elongated. In an example the lengths of the slits are about seven times their width. In an example the slits are arranged in a plurality of rows and columns. In an example the slits of the rows and columns are regularly spaced. In an example the slits are produced using an open pillar chain stitch and an inlay that form a ground for a mesh. In an example the mesh is produced by pattern bars. In an example over and under laps of a front guide bar knitting the mesh are configured to hold, on the technical back of the fabric, an inlay pattern threads of guide bars behind it at each course.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the inventions. In the figures, identical or nearly identical components illustrated in various figures may be represented by a like reference character or numeral. For purposes of clarity, not every component may be labeled in every figure. In the figures.

DETAILED DESCRIPTION

Examples of the constructions, systems, methods and apparatuses discussed herein are not limited in application to the details of construction and the arrangement of components set forth in the following description or illustrated in the accompanying drawings. The constructions, systems, methods and apparatuses are capable of implementation in other examples and of being practiced or of being carried out in various ways. Examples of specific implementations are provided herein for illustrative purposes only and are not intended to be limiting. In particular, functions, components, elements, and features discussed in connection with any one or more examples are not intended to be excluded from a similar role in any other examples.

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

Also, the phraseology and terminology used herein is for the purpose of description and should not be regarded as limiting. Any references to examples, components, elements, acts, or functions of the constructions, devices, systems and methods herein referred to in the singular may also embrace embodiments including a plurality, and any references in plural to any example, component, element, act, or function herein may also embrace examples including only a singularity. Accordingly, references in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Figure 1A:
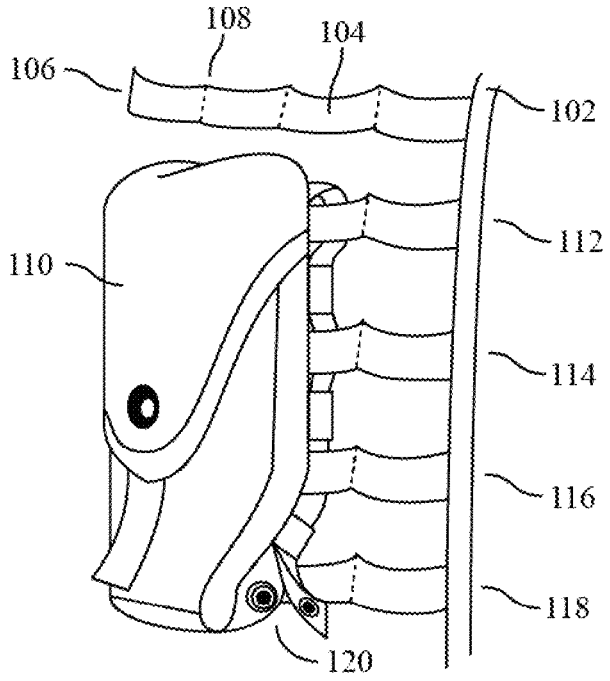
FIGS. 1*a* and 1*b* are fragmentary illustrations of the two different prior art grid accessory attachment platforms.

FIG. 1*a* is a fragmentary illustration of a conventional MOLLE PALS webbing attachment system. The system includes a panel 102 and an array of vertically aligned open loops 104 that are comprised of horizontal rows 106 of 1 inch nylon webbing spaced 1 inch apart and attached to a panel by sewing or other means 108 at 1.5-inch intervals. Straps on attachment members, which here is illustrated as a pouch 110, are interlocked or woven through the loops 104 of successive rows 112, 114, 116, and 118 then snapped at the end 120 to hold the equipment in place.

Figure 1B:
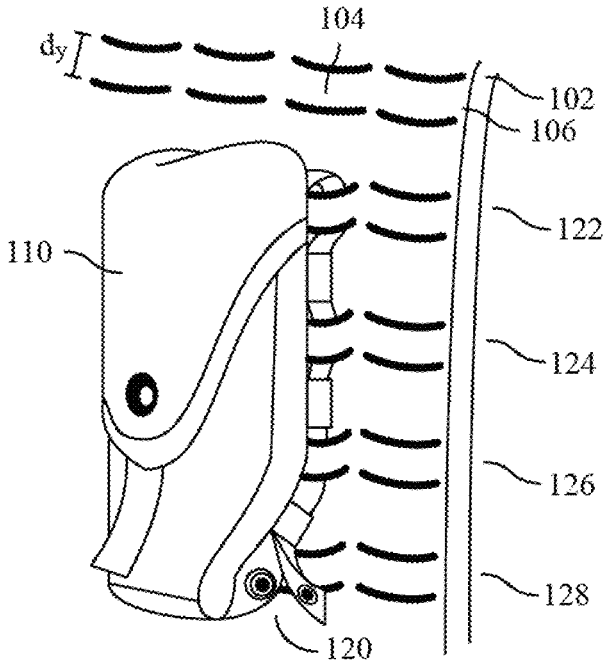

FIG. 1*b* is a fragmentary illustration of a slit panel attachment system. The system includes a panel 102 and an array of vertically aligned open loops 104 of horizontal rows 106 defined by the vertical spaces between the slits $d_y$. Straps on attachment members, which here is illustrated as a pouch 110, are interlocked or woven through the loops 104 of successive rows 122, 124, 126, and 128 then snapped at the end 120 to hold the equipment in place.

Figure 2A:
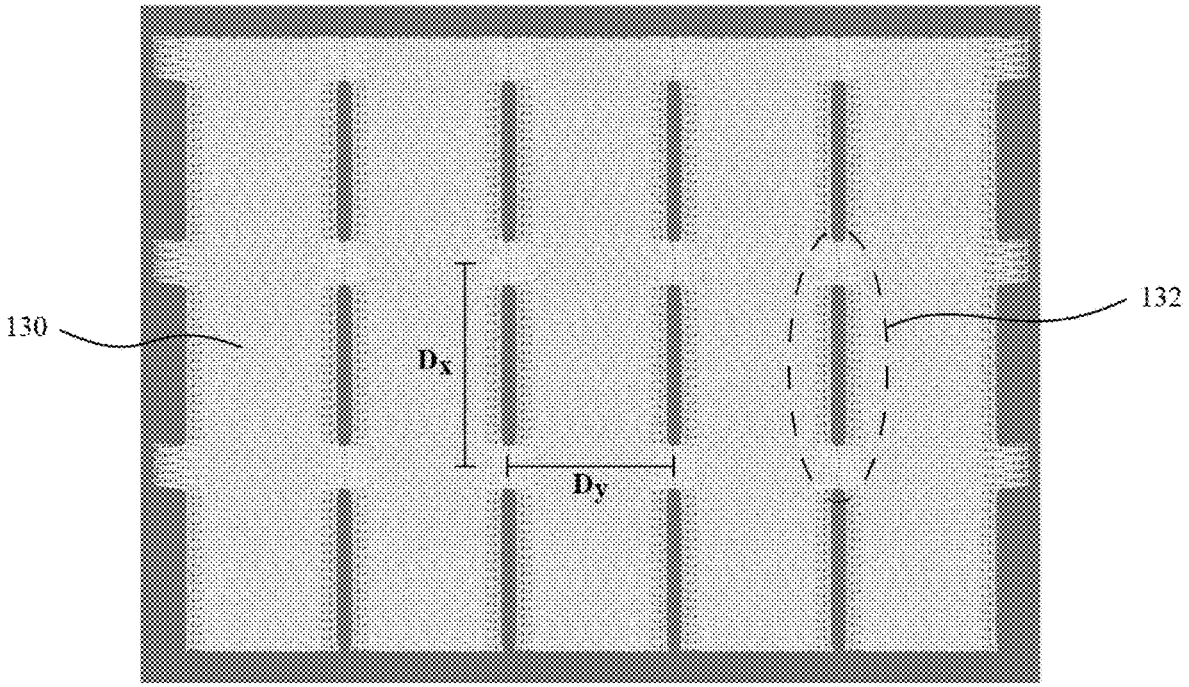
FIG. 2*a* diagrammatically illustrates in top plan view, and FIG. 2*b* a partially exploded view of an example of the integrally knit slit, of the general construction of a preferred embodiment of a modular grid accessory attachment system platform/textile with integrally knit slits of the invention.
Figure 2B:
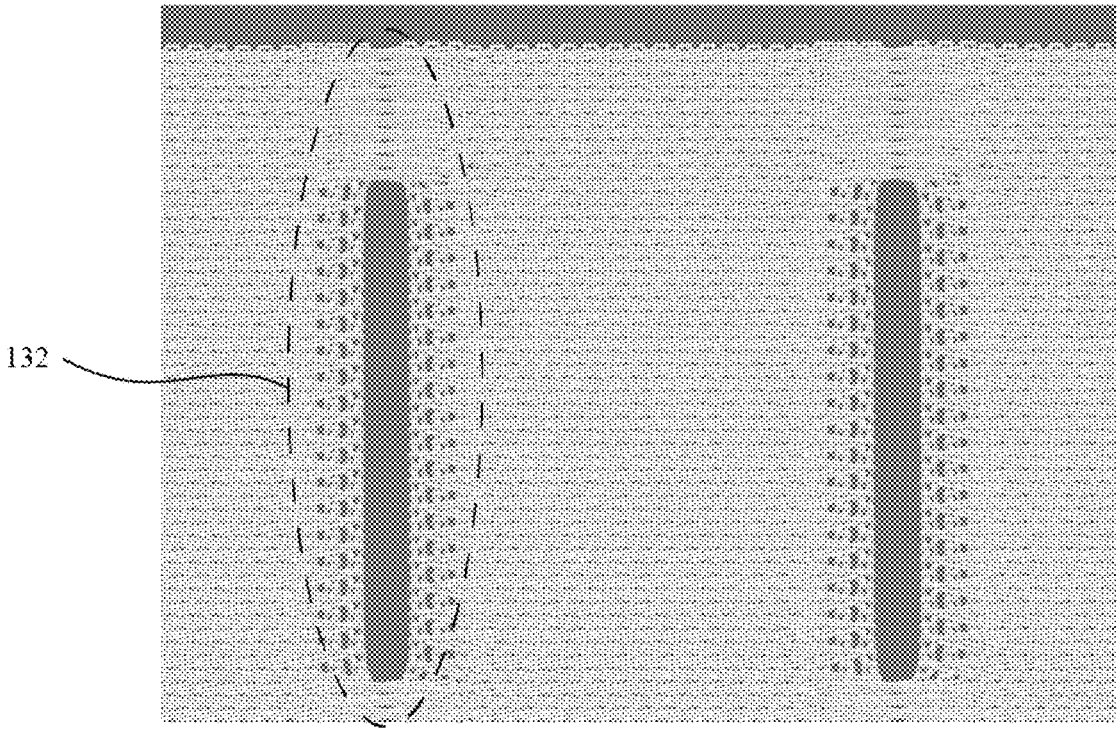

FIG. 2*a* diagrammatically illustrates in top plan view knitted textile 130, and FIG. 2*b* a partially exploded view of the integrally knit slit 132 of textile 130, of the general construction of a preferred embodiment of an integrally knit slit modular attachment grid accessory system platform/textile. In textile 130, slits 132 are all the same length and width, and they are regularly spaced, to form a plurality of aligned columns and rows of slits. However, the slits don't all need to be the same length or width, and they do not need to be regularly spaced. The fibers comprising textile 130 can include fibers formed from various materials such as natural materials (e.g. cotton, flax, etc.), polymeric materials (e.g. polyesters, polyamides, etc.), inorganic materials (e.g. glass fibers, carbon fibers, etc.), and combinations thereof, the type and size of which will be predicated by the physical requirements of the textile. The plurality of slits are spaced apart by distances $d_x$ and $d_y$, labeled in accordance with FIG. 1*a-b* orientation, where distance $d_x$ and $d_y$ is predicated by the desired modular system grid configuration, either pre-existing, for example MOLLE-PALS, or a new system. Distances $d_x$ and $d_y$ are dependent upon the knit structure, the gauge of the machine on which the fabric is knitted and the size of the yarns making up the fabric. These spaces are thus design choices.

FIG. 3*a-d* are warp knit guide bar-lapping diagrams with point paper notations (the needle heads being represented as dots) of the preferred embodiment of the modular attachment system textile with integrally knit slits 130, as explained further below.

Figure 4A:
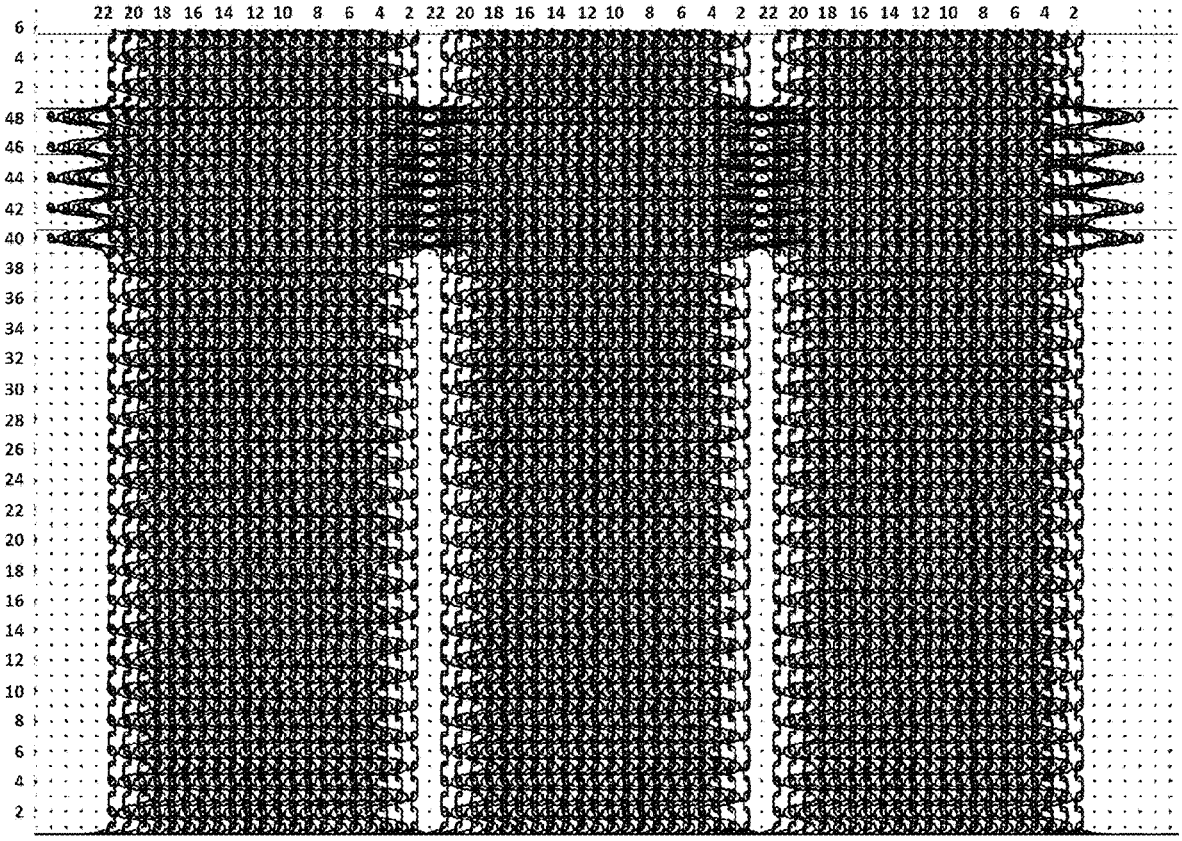
FIG. 4*a* diagrammatically shows the complete lapping of three (3) repeats and FIG. 4*b* shows the lapping connection forming the slit stitch of the preferred embodiment of the integrally knit slit modular grid accessory attachment system platform/textile of the invention.
Figure 4B:
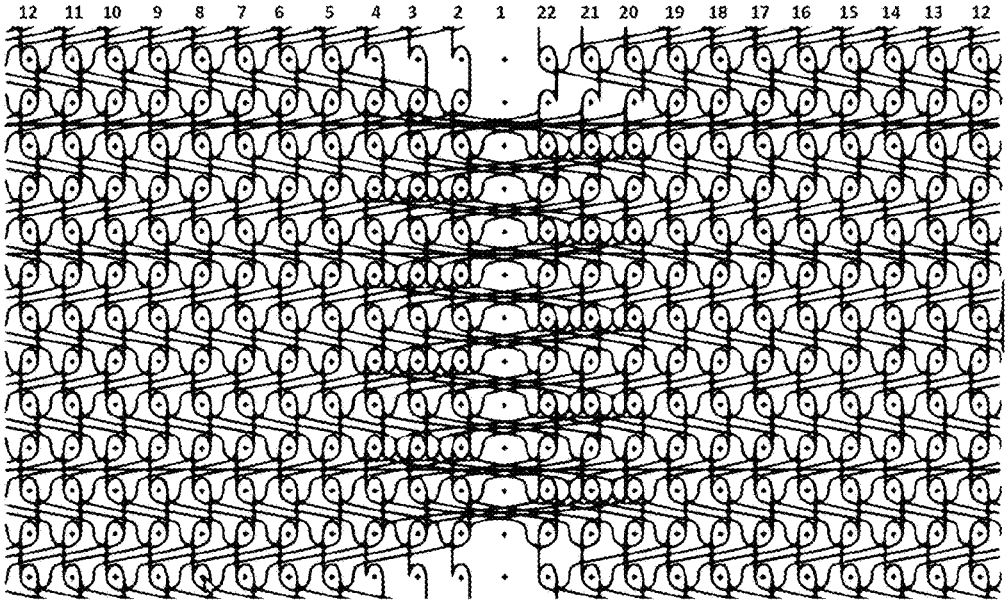

FIG. 4*a* diagrammatically shows the complete lapping of three (3) repeats and FIG. 4*b* shows the lapping connection forming the slit stitch of the preferred embodiment of the modular attachment system textile with integrally knit slits as explained further below.

NON-LIMITING EXAMPLE

The following is an example of the practiced invention utilizing an integrally warp knit slit textile architecture, an example of which is shown diagrammatically in FIG. 2*a* (130). As indicated above, one form of the modular attachment system textile with integrally knit slits may be a warp knit fabric wherein the fabric has a dominant aperture construction defined in the form of slits in a repeated grid pattern.

The plurality of slits is spaced apart by a distance $d_x$ and $d_y$ (see FIGS. 2*a* and 2*b*) where distance $d_x$ and $d_y$ is predicated by the desired modular system grid configuration, either pre-existing, for example MOLLE-PALS, or a new system. Distances $d_x$ and $d_y$ are dependent upon the knit structure, the gauge of the machine on which the fabric is knitted and the size of the yarns making up the fabric. These spaces are thus design choices. In one non-limiting example the knitted slits have a length of 35 mm and a width of 5 mm, making the length to width ratio seven.

Further to the example, FIGS. 3*a-d* are warp knit yarn guide bar lapping (looping) diagrams with point paper notations of a said suitable integrally knit slit textile 130. Point paper notation denotes the knitting repeat sequence and the resulting fabric structure. Each dot or point represents a needle in plan view, and after the yarn path has been drawn it represents the stitch. Each horizontal row of points represents adjacent needles during the same knitting cycle and the course produced by them, and each vertical row of points represents a wale produced through successive knitting cycles. In warp knitting loops are termed 'laps' as the yarn is lapped around the needles by the warp yarn guides to form the loop structure, hence the term lapping diagram and lapping motion.

Described simply FIGS. 3*a-d* depict the lapping of a mesh structure. Here an open pillar chain stitch, FIG. 3*a*, and an inlay, FIG. 3*d*, form the ground for the mesh produced by the pattern bars, FIGS. 3*b* and 3*c*. The over and under laps of the front guide bar knitting the mesh will hold, on the technical back of the fabric, the inlay pattern threads of guide bars behind it at each course.

Figures 3A, 3B, 3C, 3D:
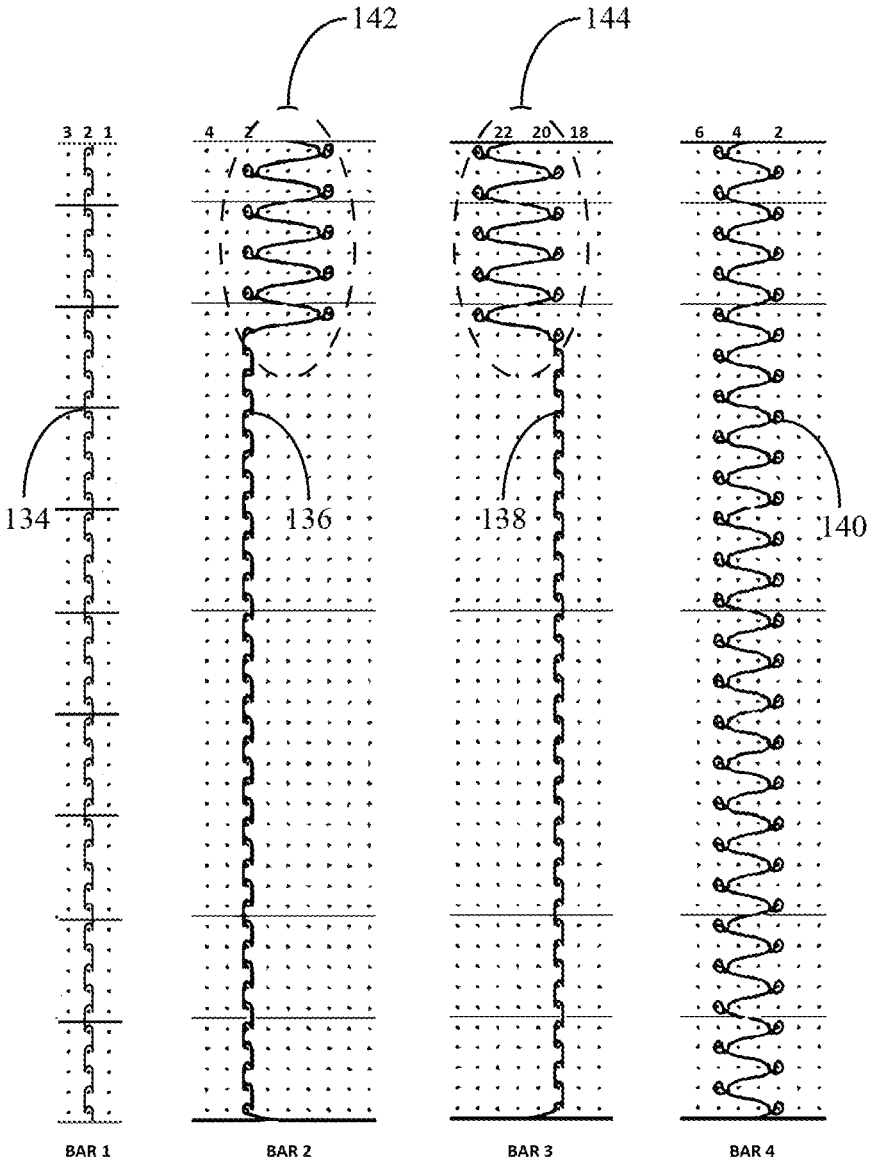
FIGS. 3*a-d* diagrammatically shows the lapping motions of the preferred embodiment of a modular grid accessory attachment system platform/textile with integrally knit slits of the invention.

More specifically, the lapping motion of a suitable ground is shown in FIGS. 3*a* and 3*d* where FIG. 3*a* Guide Bar 1 is shown to undergo a 1-1-0-0/0-0-1-1 repeat motion in order to create an open chainstitch defined by yarn 134 as linked in by weft yarn 140 which undergo a 1-1-0-0/3-3-4-4 repeat motion in order to create an inlay over 4 needles as shown in FIG. 3*d* Guide Bar 4. Yarns for 134 and 140 can be any one of the contemplated yarns or combinations thereof. Likewise yarns 134 and 140 need not be the same.

The lapping motion for a suitable slit stitch is shown in FIGS. 3*b* and 3*c*. The slit stitch formed by two connectors where FIG. 3*b* Guide Bar 2 is shown to undergo a 5-5-4-4/4-4-5-5 repeat motion in order to create an open chainstitch followed by a 5-5-4-4/1-1-0-0 repeat motion in order to create an inlay over 5 needles to create the right facing connector 142 defined by yarn 136 and FIG. 3*c* Guide Bar 3 is shown to undergo a 1-1-0-0/0-0-1-1 repeat motion to in order to create an open chainstitch followed by a 1-1-0-0/4-4-5-5 repeat motion in order to create an inlay over 5 needles to create the left facing connector 144 defined by yarn 136. In the preferred embodiment the length of the open chainstitch and the succeeding inlays are matched between Guide Bar 2 and 3, thusly forming the slit. The repeat length of the open chainstitch and the succeeding inlay lengths control the length and spacing of the slit, and the number of needles the inlay is over controls the width of the slit.

FIG. 4*a* shows the lapping motion of Bars 1 through 4 as three repeats and FIG. 4*b* shows the lapping connection forming the slit stitch. The resulting textile is preferably heat set after knitting in order to remove lubricants, conditioners, etc. from the yarn. The heating is preferably performed on tenters disposed lengthwise such as to affix the machine state weft dimension during the setting process. Articles thus obtained show excellent stability whereas the starting knitted fabric is in itself somewhat deformable. The textile may also be finished with a form of resin coating, such as an acrylic, that acts to further stabilize the architecture, durable water-resistant coatings (DWR), ultraviolet stabilizers, etc.

Further to the example Table 1 below details the knitting specification and resulting textile per the example presented in FIGS. 3*a-d* and 4*a-b*.

TABLE 1

| | | | |
|---|---|---|---|
| Style Reference | M3466 | Courses per inch | 26.2 |
| Machine Reference | R54 | Finishing Specification | DWR C6 6%, RM3 (thermoset resin) 1%, 380° F. at 15 yards/min. throughput |
| Machine Type | 18E Raschel | Finished Weight | 12 oz./yd.^2 |

| | | Construction | | |
|---|---|---|---|---|
| Bar | Yarn | Ends per Guide | Feed Rate (in./rack) | Patterning Description |
| 1 | 260/68 Nylon 6 Bright | 1 | 102 | Open Pillar |
| 2 | 420/68 Nylon 6,6 Bright | 1 | 108 | Left facing slit stitch |
| 3 | 420/68 Nylon 6,6 Bright | 1 | 108 | Right facing slit stitch |
| 4 | 420/68 Nylon 6,6 Bright | 1 | 153 | Ground Inlay |

Chain Details

| | | | | | | |
|---|---|---|---|---|---|---|
| GB1 | 1-1-0-0/ | 0-0-1-1/ | 1-1-0-0/ | 0-0-1-1/ | 1-1-0-0/ | 0-0-1-1/ |
| | 1-1-0-0/ | 0-0-1-1/ | 1-1-0-0/ | 0-0-1-1/ | 1-1-0-0/ | 0-0-1-1/ |
| | 1-1-0-0/ | 0-0-1-1/ | 1-1-0-0/ | 0-0-1-1/ | 1-1-0-0/ | 0-0-1-1/ |
| | 1-1-0-0/ | 0-0-1-1/ | 1-1-0-0/ | 0-0-1-1/ | 1-1-0-0/ | 0-0-1-1/ |
| | 1-1-0-0/ | 0-0-1-1/ | 1-1-0-0/ | 0-0-1-1/ | 1-1-0-0/ | 0-0-1-1/ |
| | 1-1-0-0/ | 0-0-1-1/ | 1-1-0-0/ | 0-0-1-1/ | 1-1-0-0/ | 0-0-1-1/ |
| | 1-1-0-0/ | 0-0-1-1/ | 1-1-0-0/ | 0-0-1-1/ | | |
| GB2 | 5-5-4-4/ | 4-4-5-5/ | 5-5-4-4/ | 4-4-5-5/ | 5-5-4-4/ | 4-4-5-5/ |
| | 5-5-4-4/ | 4-4-5-5/ | 5-5-4-4/ | 4-4-5-5/ | 5-5-4-4/ | 4-4-5-5/ |
| | 5-5-4-4/ | 4-4-5-5/ | 5-5-4-4/ | 4-4-5-5/ | 5-5-4-4/ | 4-4-5-5/ |
| | 5-5-4-4/ | 4-4-5-5/ | 5-5-4-4/ | 4-4-5-5/ | 5-5-4-4/ | 4-4-5-5/ |

TABLE 1-continued

| | | | | | | |
|---|---|---|---|---|---|---|
| | 5-5-4-4/ | 4-4-5-5/ | 5-5-4-4/ | 4-4-5-5/ | 5-5-4-4/ | 4-4-5-5/ |
| | 5-5-4-4/ | 1-1-0-0/ | 4-4-5-5/ | 1-1-0-0/ | 4-4-5-5/ | 1-1-0-0/ |
| | 4-4-5-5/ | 1-1-0-0/ | 4-4-5-5/ | 1-1-0-0/ | | |
| GB3 | 1-1-0-0/ | 0-0-1-1/ | 1-1-0-0/ | 0-0-1-1/ | 1-1-0-0/ | 0-0-1-1/ |
| | 1-1-0-0/ | 0-0-1-1/ | 1-1-0-0/ | 0-0-1-1/ | 1-1-0-0/ | 0-0-1-1/ |
| | 1-1-0-0/ | 0-0-1-1/ | 1-1-0-0/ | 0-0-1-1/ | 1-1-0-0/ | 0-0-1-1/ |
| | 1-1-0-0/ | 0-0-1-1/ | 1-1-0-0/ | 0-0-1-1/ | 1-1-0-0/ | 0-0-1-1/ |
| | 1-1-0-0/ | 0-0-1-1/ | 1-1-0-0/ | 0-0-1-1/ | 1-1-0-0/ | 0-0-1-1/ |
| | 1-1-0-0/ | 4-4-5-5/ | 1-1-0-0/ | 4-4-5-5/ | 1-1-0-0/ | 4-4-5-5/ |
| | 1-1-0-0/ | 4-4-5-5/ | 1-1-0-0/ | 4-4-5-5/ | | |
| GB4 | 1-1-0-0/ | 3-3-4-4/ | 1-1-0-0/ | 3-3-4-4/ | 1-1-0-0/ | 3-3-4-4/ |
| | 1-1-0-0/ | 3-3-4-4/ | 1-1-0-0/ | 3-3-4-4/ | 1-1-0-0/ | 3-3-4-4/ |
| | 1-1-0-0/ | 3-3-4-4/ | 1-1-0-0/ | 3-3-4-4/ | 1-1-0-0/ | 3-3-4-4/ |
| | 1-1-0-0/ | 3-3-4-4/ | 1-1-0-0/ | 3-3-4-4/ | 1-1-0-0/ | 3-3-4-4/ |
| | 1-1-0-0/ | 3-3-4-4/ | 1-1-0-0/ | 3-3-4-4/ | 1-1-0-0/ | 3-3-4-4/ |
| | 1-1-0-0/ | 3-3-4-4/ | 1-1-0-0/ | 3-3-4-4/ | 1-1-0-0/ | 3-3-4-4/ |
| | 1-1-0-0/ | 3-3-4-4/ | 1-1-0-0/ | 3-3-4-4/ | | |

From Table 1 the knitting machine used to produce the example 130 is an 18 E gauge (needle per inch) Raschel warp knitting machine. The example 130 is finished with a Durable Water Resistant (DWR) coating and stiffened with a thermoset resin. Post the finish application the example 130 is heat set in a tenter frame at 380° F. at frame throughput of 15 yards per minute. Below the "Construction" heading, "Bar" refers to the warp yarn guide bar number, the ends per guide refers to the number of yarn ends through a threaded guide, and Feed Rate refers to the number of linear inches of yarn fed through the yarn guide for every 480 courses (Rack). The threading refers to the sequence in which each bar is threaded where a '|' indicates the guide is threaded and '.' indicates a guide is not threaded. The Chain Notation indicates the sideways (shogging) movement of the guide bar that occurs parallel to the needle bar. The term 'Chain' refers to the pattern chain links or pattern wheel that mechanically links the guide bar to the machine drive shaft, separately controlling the occurrence, timing, direction and extent of each shog. In electronic machines a separate linear motor directly shogs each guide bar eliminating the mechanical chain or pattern wheel; however, the Chain Notation remains the same whether the machine is mechanical or electronic. The Chain Notation in Table 1 directly reflects the lapping motion shown in FIGS. 3*a-d*.

Figure 5A:
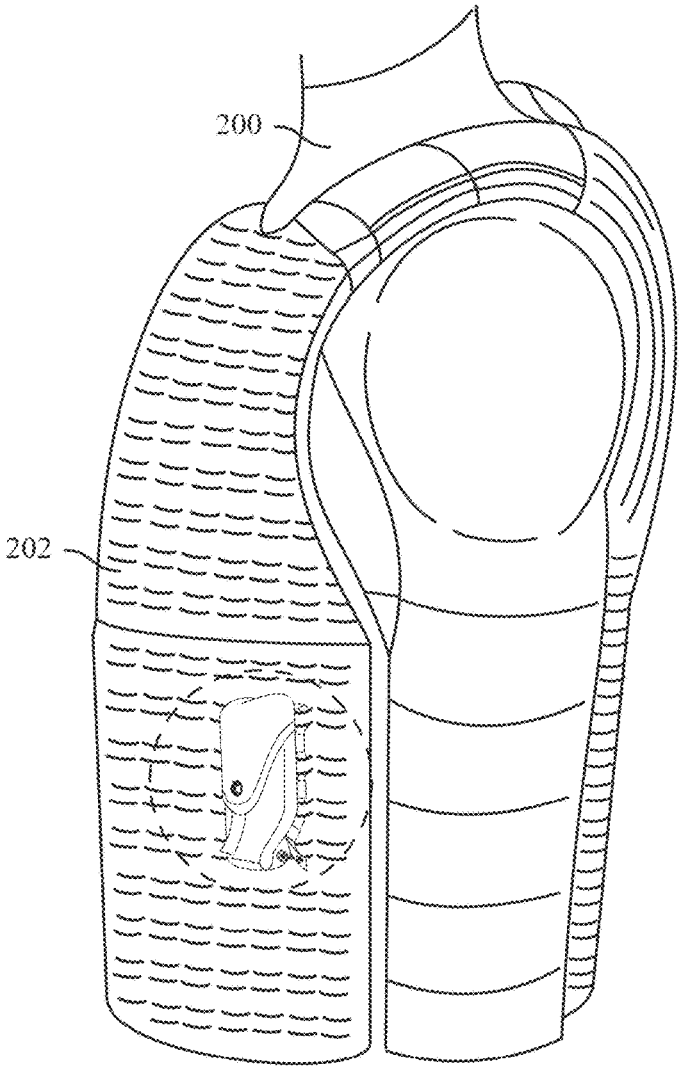
FIG. 5*a* illustrates a person wearing an exemplary grid accessory attachment system platform/textile, and carrying an accessory.
Figure 5B:
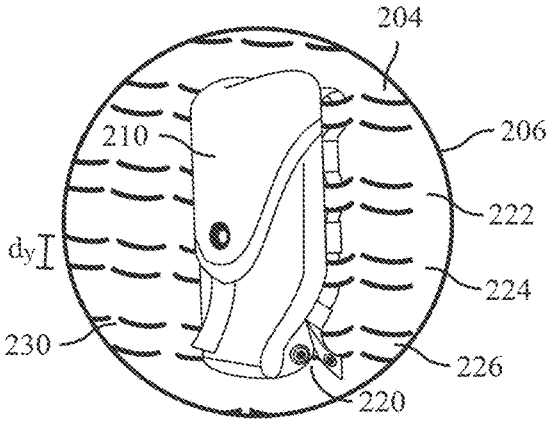
FIG. 5*b* is a close-up view of portion 206 of FIG. 5*a*.
Figure 6:
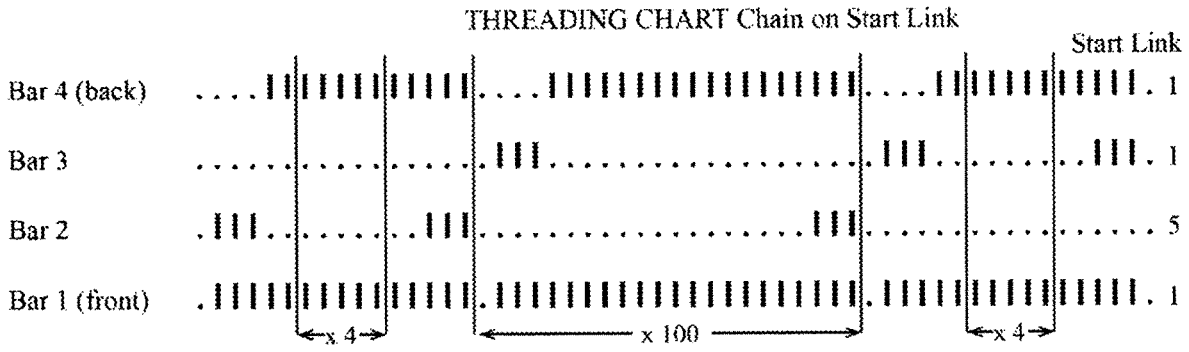
FIG. 6 sets forth a Threading Chart for Table 1, which details the knitting specification and resulting textile per the example presented in FIGS. 3*a-d* and 4*a-b*.

FIG. 5*a* illustrates a person 200 wearing an exemplary grid accessory attachment system platform/textile 202, and carrying an accessory 210, and FIG. 5*b* is a close-up view of portion 206. Textile 202 has a number of regularly-spaced slits 230 with widths $d_y$, arranged with their lengths essentially horizontal. This presents a number of regularly spaced rows and columns of slits, with rows 204, 222, 224, and 226 labelled. Accessory 210 has a strap that is threaded through three of the vertically aligned slits of rows 206, 222, and 224. A snap (not numbered) is located on the strap and the accessory to snap the strap closed once it has been threaded through the three slits. This holds the accessory on the textile.

The manner of usage and operation of the present invention, and variations and equivalents thereof, will be apparent to those skilled in the art from the above description, and it will be recognized that a wide variety of specific practices may be employed.

With respect to the above description and examples, it is also to be recognized that the optimum dimensional relationships for the parts of the invention, may include variations in size, materials, shape, form, function and manner of operation, assembly and use.

Obviously, the invention is not limited to the examples given hereinabove and, on the contrary, covers any variants thereof which remain with its scope or its spirit.

Also, the articles according to the invention could also be produced on any other warp knit machine.

Therefore, the foregoing specific working embodiments are considered as illustrative only of the principles of the invention. Further, numerous modifications and changes thereto may be made by those skilled in the art without departing from the spirit of this invention, which is limited only by the scope of the following claims.

Having described above several aspects of at least one example, it is to be appreciated that various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A modular attachment system, comprising:

a load-bearing, integrally knit warp knitted textile produced by knitting a polymer yarn on a single needle bar warp knitting machine, the textile defining a plurality of spaced slits formed during the knitting process and integrally knit into the textile;

wherein the textile comprises a ground structure formed by a plurality of courses of an open pillar chain stitch and an inlay, the ground structure configured to hold, on a technical back of the textile, inlay pattern threads at each course;

wherein the plurality of spaced slits are defined by a series of spaced knitted pairs of overlapping right facing and left facing connectors formed using a plurality of guide bars of the knitting machine, the pairs of connectors defining the ends of the slits; and wherein opposed spaced sides of the slits between the ends of the slits are defined by open chain stitching that interconnects both the right connectors of two spaced pairs of connectors that define the ends of the slit and the left connectors of the same two spaced pairs of connectors that define the ends of the slit.

2. The modular attachment system of claim 1, wherein the slits have a length and a width, wherein the slits have lengths greater than their widths such that the slits are elongated.

3. The modular attachment system of claim 2, wherein the lengths of the slits are seven times their width.

4. The modular attachment system of claim 2, wherein the slits are arranged in a plurality of rows and columns.

5. The modular attachment system of claim 4, wherein the slits of the rows and columns are regularly spaced.

6. The modular attachment system of claim 2, wherein the mesh is produced by pattern bars.

7. The modular attachment system of claim 6, wherein over and under laps of a front guide bar knitting the mesh are configured to hold, on the technical back of the fabric, an inlay pattern threads of guide bars behind it at each course.

8. A method of creating a modular attachment system, comprising:

using a warp knitting machine with a single needle bar and a plurality of guide bars to knit a load bearing, integrally knit textile from a polymer yarn that is suitable for load-bearing applications, the knitting process comprising:

forming a ground structure using a plurality of courses of an open pillar chain stitch and an inlay, the ground structure configured to hold, on a technical back of the textile, inlay pattern threads at each course;

forming a plurality of spaced slits integrally knit into the textile by alternating at least two guide bars between the open pillar chain stitch and a succeeding inlay to form a series of spaced knitted pairs of overlapping right facing and left facing connectors, the pairs of connectors defining the ends of the slits;

wherein opposed spaced sides of the slits between the ends of the slits are defined by open chain stitching that interconnects both the right connectors of two spaced pairs of connectors that define the ends of the slit and the left connectors of the same two spaced pairs of connectors that define the ends of the slit; and then after the knitting process, heat setting the knit textile to affix a machine state weft dimension of the textile.

9. The modular attachment system of claim 1 wherein the polymer of the yarn is a polyamide.

10. The modular attachment system of claim 9 wherein the polymer of the yarn is a nylon.

11. The modular attachment system of claim 10 wherein the polymer of the yarn is nylon 6,6.

12. The modular attachment system of claim 1 wherein the polymer of the yarn is a polyester.

13. The modular attachment system of claim 1 further comprising an accessory comprising an attachment member that is configured to pass through a plurality of the slits to hold the accessory on the textile.

14. The modular attachment system of claim 13 wherein the attachment member comprises a strap.

15. The modular attachment system of claim 14 wherein the strap has two ends and is configured to be releasably coupled to the accessory at one end, to allow the strap to be threaded through the slits and then coupled to the accessory.

16. The modular attachment system of claim 15 wherein the plurality of slits that the strap is threaded through are adjacent and are vertically aligned.

17. The modular attachment system of claim 1 wherein the warp knitted textile further comprises an inorganic material.

* * * * *